United States Patent [19]

Rowland

[11] Patent Number: 4,648,653

[45] Date of Patent: Mar. 10, 1987

[54] STACKABLE ARMCHAIR

[76] Inventor: David L. Rowland, 315 E. 91st St., New York, N.Y. 10128

[21] Appl. No.: 869,190

[22] Filed: May 30, 1986

[51] Int. Cl.[4] ..... A47C 3/04

[52] U.S. Cl. ..... 297/239; 297/445

[58] Field of Search ..... 297/239, 440, 445, 248; 108/91; 211/182

[56] References Cited

U.S. PATENT DOCUMENTS 3,278,227 10/1966 Rowland ..... 297/239

3,404,916 10/1968 Rowland ..... 297/239

FOREIGN PATENT DOCUMENTS 267025 3/1963 Australia ..... 297/239

*Primary Examiner*—James T. McCall

*Attorney, Agent, or Firm*—Owen, Wickersham & Erickson

[57] ABSTRACT

A stacking armchair having two symmetrical front frame members, each having a bottom rail portion, a front leg portions, and a seat side rail portion, a rear connecting member connecting together the rear ends of the side frame portion, a front brace across the front leg portions. All these are made from thin rod stock. The rear of each bottom rail portion has a turned-up generally vertical terminal portion, and the rear connecting member extends out beyond the seat side rail portions. Two rear leg members are made of rod stock greater in thickness, strength, and stiffness than the rod stock from which the front frame members are made. The rear leg members are butt-welded at their lower ends to the tops of the terminal portions and are also welded to the ends of the rear connecting member. A seat is secured to the side rail portions and to the rear connecting member, and a back is secured to upper portions of the rear leg members. At its upper end each rear leg member is bent to provide a short, straight, outwardly extending horizontal portion and then bent again to provide an arm-support portion parallel to the side rail portion but outboard from it. A flat arm-support plate is secured to this arm-support portion, and an armrest is secured to the arm-support plate.

8 Claims, 8 Drawing Figures

FIG 2
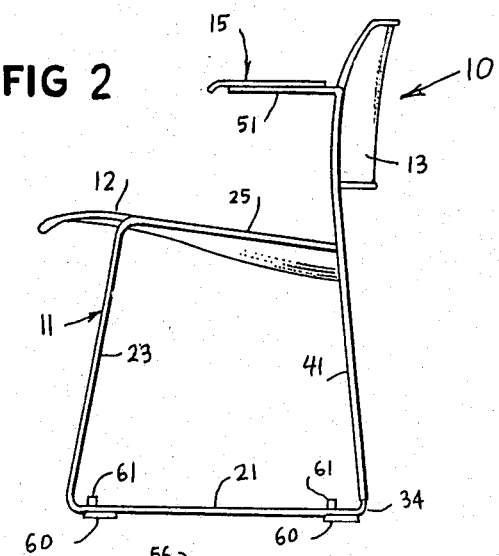
FIG 1
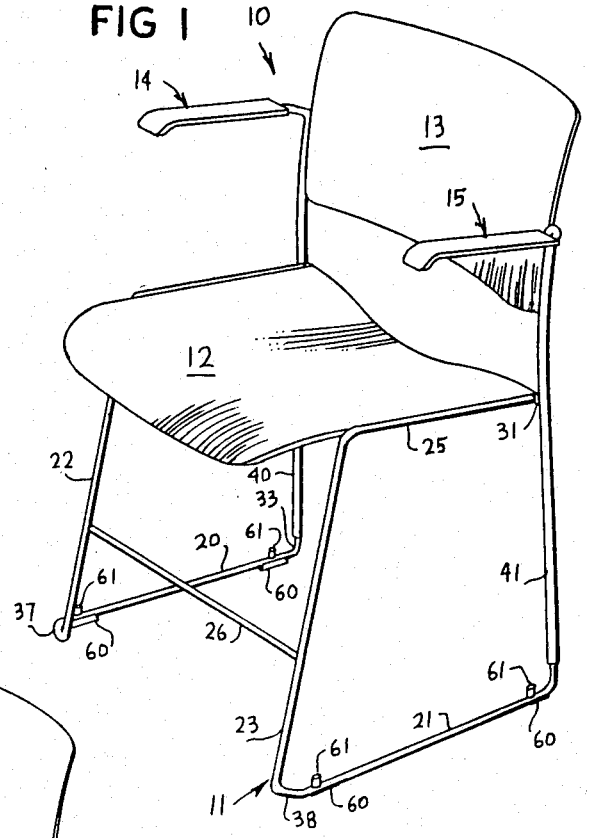
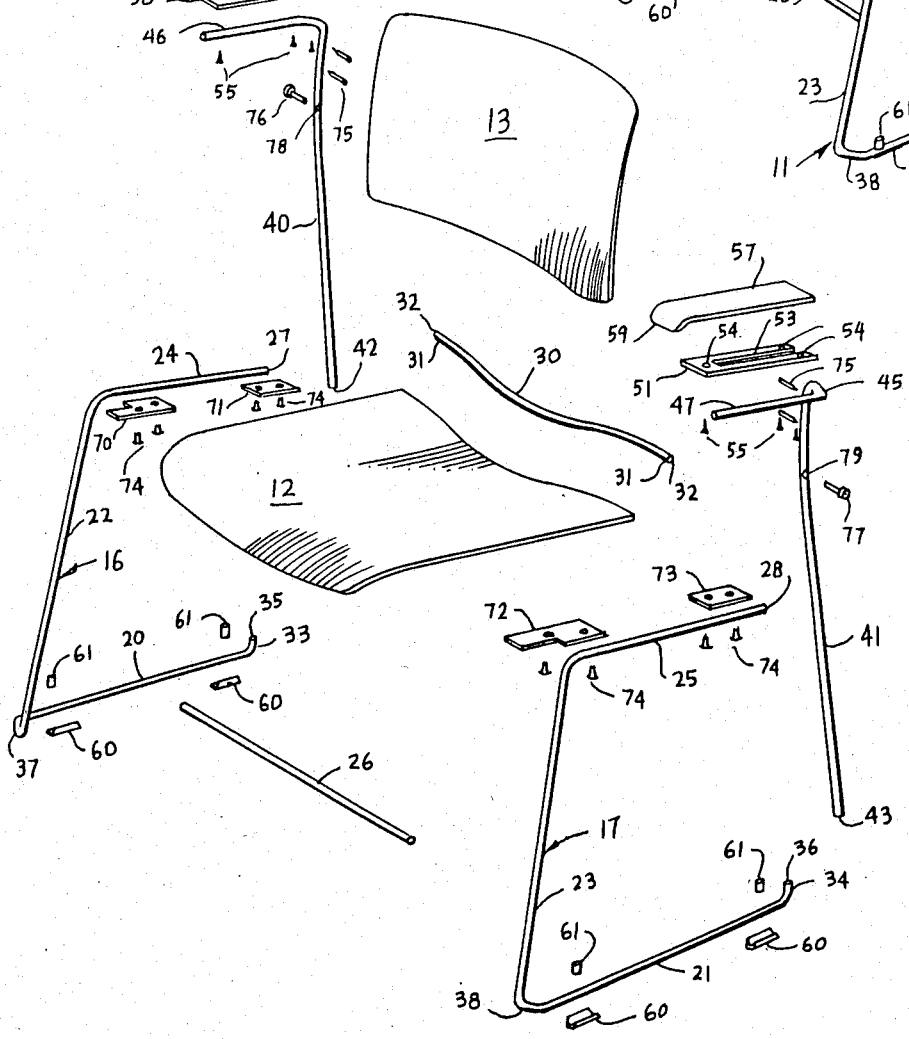
FIG 3

STACKABLE ARMCHAIR

This invention relates to a stackable armchair.

It is an improvement over the nested armchair shown in my earlier patent U.S. Pat. No. 3,446,530, issued May 27, 1969. It also is related to the three armless stackable chairs shown in my earlier U.S. Pat. Nos. 3,080,194, issued Mar. 5, 1963; 3,275,371, issued Sept. 27, 1966; and 3,404,916, issued Oct. 8, 1968.

This invention was disclosed in Disclosure Document No. 143139 dated Oct. 23, 1985.

BACKGROUND OF THE INVENTION

The nested armchair of U.S. Pat. No. 3,446,530 was found to be too costly and to lack client acceptance. These drawbacks were due to the need for the two rods which were connected to the two bottom rails in order to support the front end of each arm. There remained a need for a suitably stackable armchair which has an appearance and function more closely related to my patents named above to the armless chairs.

Some other chairs cantilevered the arms forward from the rear leg, but this resulted in an unsatisfactory soft feeling, a feeling that the arms could not be relied on for support but would give way.

SUMMARY OF THE INVENTION

The stacking armchair of this invention has two symmetrical front frame members, each providing a bottom rail, a front leg portion, and a seat-supporting side rail portion. A rear connecting member is welded to the rear ends of the two side rail portions to connect them together and extends slightly past them, and a front brace bridges between the front leg portions and is welded to them. All these front frame members are made from thin steel rod.

The frame is completed by two rear leg and arm-support members made from steel rod that is thicker and stronger and stiffer than the rod from which the front frame members are made. The rear leg members are each butt welded (or gas welded, brazed, or connected with drive pins) at their lower ends to an upwardly projecting terminal portion of the bottom rail portions of the side frame members. They are also welded to the projecting ends of the rear connecting member, which is at the level of the seat-supporting side rails. At its upper end, each rear leg rod is bent out around an angle to provide a short, straight horizontal portion. Then this rod is bent again to extend forward, parallel to the seat-supporting rail below it, but lies outside it. This arm-supporting portion extends forward about half of the side extent of the chair.

The side rails and rear connecting member support a shaped seat, and the legs support a chair back.

An arm-support bracket is secured to the arm-support portion of the rear frame, and an arm is secured to the arm-support bracket.

The present invention places strong reliance on the use of two different rod materials in the main frame of the chair—the thinner rod for the front frame member, and the thicker, stronger rod for the rear legs and arm support. Since the identical rod is used for both supporting the arm and as the rear leg, this structure enables the arms to be supported adequately while still not needing any supporting rod to go from the forward parts of the arms down to the bottom rails, as in my earlier U.S. Pat. No. 3,446,530. Instead the arm has a practically invisible support from the rear leg portion of the frame.

By doing without the post supports of U.S. Pat. No. 3,446,530, the cost can be substantially reduced while simultaneously improving the visual appearance of the chair. By using the larger and stiffer rods for the rear legs and arm supports of this invention, the unsatisfactory soft feeling that one has tended to get from cantilevered arms on an armchair is avoided. Both visual and structural simplicity are maintained while getting the desired results.

Other objects and advantages of the invention will appear from the drawings and from the detailed description that follows.

BRIEF DESCRIPTION OF THE DRAWINGS

FIG. 1 is a view in perspective of a stacking armchair embodying the principles of this invention.

FIG. 2 is a view in side elevation of the chair of FIG. 1.

FIG. 3 is an exploded view in perspective of the chair of FIG. 1.

DESCRIPTION OF A PREFERRED EMBODIMENT

Figure 4:
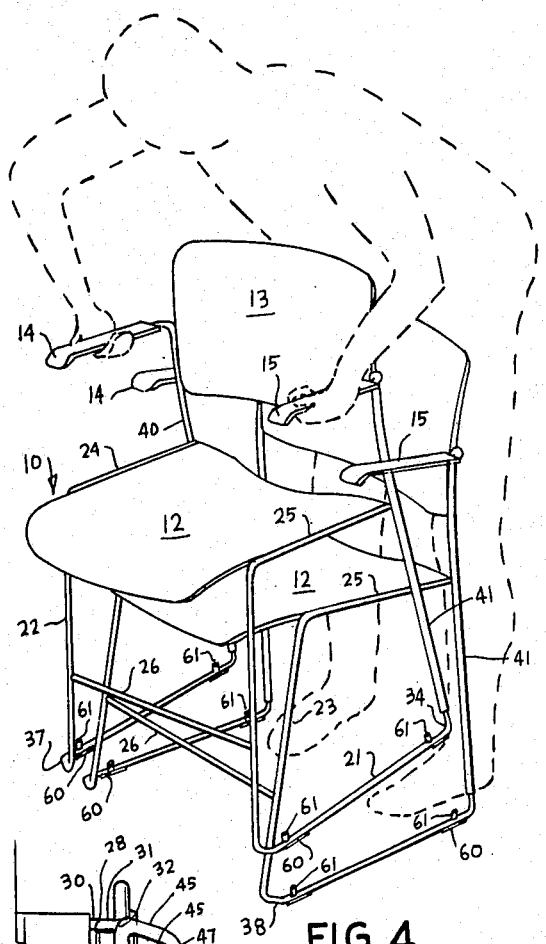
FIG. 4 is a view in perspective showing one chair being stacked on top of another by a person whose outline is shown in broken lines.

A chair 10 of this invention, as shown in FIGS. 1 and 2, includes a frame 11, a seat 12, a back support 13, and two arms 14 and 15. In many ways the chair 10 is like that of my previous patents, but there are important differences, which will be pointed out.

Figure 6:
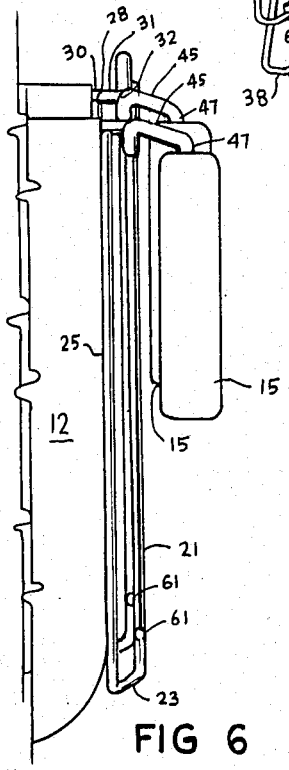
FIG. 6 is a top plan fragmentary view of the arm and adjacent frame portion of two stacked chairs.

The exploded view, FIG. 3, shows that the frame 11 is made in several pieces. Thus, there are two side frame members 16 and 17, symmetrical to each other, each of which includes a bottom rail 20 or 21, a front leg portion 22 or 23, and a seat supporting rail 24 or 25, all made by forming the same rod. To brace the front legs 22 and 23 a straight brace member 26 is welded to each of them and extends across them. The rear ends 27 and 28 of the side rails 24 and 25 are welded to a rear connecting member 30, which has portions 31 that extend beyond the side rails 24 and 25 to outboard ends 32 (see FIG. 6). The member 30 is preferably shaped to conform to the rear edge of the seat 12, which it helps to support, along with the side rails 24 and 25.

At the rear end of each bottom rail 20 and 21, a short terminal portion 33, 34 is turned upwardly, generally perpendicular to the respective bottom rail and has an upper end 35, 36. Also, it may be noted that the bottom rail 20 and 21 are connected to their respective front legs 22 and 23 by a short inturned portion 37, 38.

A front frame assembly comprises the two side frame members 16 and 17, the front brace 26, and the rear connecting member 30, welded together, and all of these members are made from the same size of thin strong steel rod, preferably 7/16 inch or 11 mm in diameter.

Figure 7:
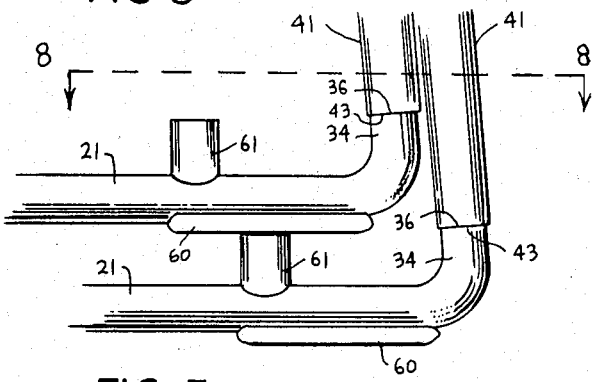
FIG. 7 is a fragmentary view in side elevation, on a large scale, of the rear corner portions of two stacked chairs.

Thicker, stronger rods, preferably ½" or 13 mm in diameter, are used to make two rear legs 40 and 41. The bottom end 42, 43 of each rear leg 40, 41 butts up against and is butt-welded to the end 35, 36 of the short terminal portions 33, 34 to the rear of the bottom rails. The rear legs 40 and 41 are also welded to the outboard ends 32 of the rear connecting member 30, best shown in FIG. 7, and this provides additional stability. Finally the rear legs 40, 41 support the chair back 13, which bridges between them and also imparts rigidity and firmness.

At their upper ends the rods forming the rear legs 40 and 41 are bent to provide short outwardly-extending horizontal portions 44 and 45 that extend somewhat forwardly, at an angle. The rod is then bent forwardly to provide arm-support portions 46 and 47. This use of a separate, thicker stronger rod for the separate rear leg 40, 41 the doubling use of the same rod as support members 46, 47 for the chair arm is a very important feature of this invention.

The arm-supporting portions 46 and 47 extend forwardly parallel to the side rails 24 and 25 but outward or outboard from them. A pair of steel armpad plates 50 and 51 are secured to the arm-support frame portions 46 and 47 respectively. Each plate 50, 51 is fitted around its arm-support portion 46, 47, having a slot 52, 53 where it is welded to the portions 46, 47 at the same level, so that the whole assembly is quite thin, both for appearance and for compact stackability. Screw-receiving openings 54, preferably three each, are provided and secrews 55 extend from the bottom of the plates 50, 51 through these openings 54 and into blind openings (not shown) on the bottom side of each arm rest 56, 57, thereby completing the arms 14 and 15.

The armrests 56 and 57 may be made from the same material as the seat 12 and back 13, or from different material if desired. Molded veneer, sheet metal, dipped in elastomeric coating, and injection molded plastic, for example, may be used. Preferably, their front ends 58 and 59 curve downwardly.

Glides 60, preferably are provided at or near both the front and the rear ends of each bottom rail portion 20, 21, and the chair 10 rests on these glides 60 rather than on the legs themselves.

Short bar members or pins 61 are provided atop each rail 20, 21 just opposite the front portion of each glide 60. When a chair 10 is stacked on top of the pins 61, the pins 61 engage the central portion of the glide 60 on the chair 10 thereabove and serve as spacer members. This prevents scratching and similar damage to the chair frames. Stacking would be a little more compact without them, but stacking remains sufficiently compact with them, and the appearance of the chairs is better preserved.

Four plates 70, 71, 72, and 73 are provided to hold the seat 12 to the side rails 24 and 25 by welding. These employ screws 74 for attachment to under side of the seat 12. The back 13 is attached by four or six drive pins 75 which are pressed into drilled holes in the rear leg posts 40 and 41, not completely penetrating. In assembly the pins 75 in the frame are pressed into corresponding drilled holes in side edges of the back 13, and screws 76 and 77 are also driven through holes 78 and 79 in each rear leg 40, 41 and into the bottom holes in the edge of the back 13.

Figure 5:
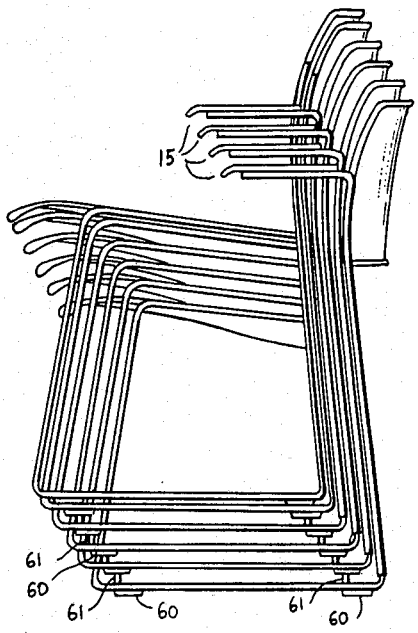
FIG. 5 is a view in side elevation of a stack of four of the chairs of the invention topped by two armless chairs of my prior invention.
Figure 8:
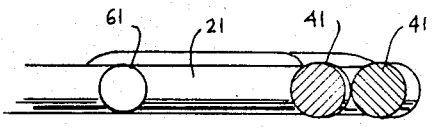
FIG. 8 is a view in section taken along the line 8—8 in FIG. 7.

The stacking is done, as shown in FIG. 4, by lifting one chair 10 over a lower chair 10 and then nesting it downwards. When several chairs 10 are in place, the appearance of the stack is like that shown in FIG. 5. If desired, the stacking could be done on a dolly at an inclination, as has been done in some of my previous patents. The glides 60 and pins 61 separate the chair 10 slightly from each other vertically, so that the arms 14, 16 do not rest on the arms 14, 15 of the lower chair 10, and the arm-support members 46, 47 and the support plates 50, 51 do not engage the armrest 56, 57 below them. The chairs 10 gradually shift forward as they are stacked, and that is the reason for stacking them on an incline, if many are to be stacked.

The chairs 10 of this invention can be stacked interchangeably in or on stacks including the armless chairs of my earlier invention as in U.S. Pat. Nos. 3,080,194 and 3,275,371.

To those skilled in the art to which this invention relates, many changes in construction and widely differing embodiments and applications of the invention will suggest themselves without departing from the spirit and scope of the invention. The disclosures and the descriptions herein are purely illustrative and are not intended to be in any sense limiting.

What is claimed is:

1. A stacking armchair including in combination:

a front frame having two bottom rail portions, two front leg portions, two seat side rail portions, a rear connecting member connecting together the rear ends of the side rail portions and extending therebeyond to the outboard ends, and a front brace portion bridging between the front leg portions, said front frame being made from thin rod stock, the rear of each bottom rail portion having a turned-up generally vertical terminal portion, two rear leg members of rod stock that is larger in diameter and greater in strength and stiffness than the rod stock from which the front frame is made, said rear leg member having a lower end welded to the said terminal portion, said rear leg portion being welded also to said outboard ends of the rear connecting member and having an upper portion extending thereabove, a seat secured to and supported by said front frame, a back secured to and bridging across the upper portion of said rear leg members, said upper portions of said rear leg members each being shaped to provide a short outwardly extending generally horizontal portion, a forwardly extending arm-support portion parallel to the seat-supporting side rail portion but outboard from it, and a chair arm supported by said arm-support portion.

2. The stacking armchair of claim 1, wherein each said bottom rail portion has a front glide and a rear glide extending below said bottom rail portion and a pair of spacer members extending above said bottom rail portion and aligned relatively to said glides to engage the glide of a like chair to be stacked thereon.

3. The stacking armchair of claim 1 wherein said arm comprises a flat arm-support plate welded to said arm-support portion in a horizontal position and an arm rest secured to said plate.

4. The stacking armchair of claim 3 wherein said arm rest extends about halfway between said back and said front legs.

5. A stacking armchair including in combination:

a front frame member having two bottom rail portions, two front leg portions, two seat side rail portions, a rear connecting portion connecting together the rear ends of the side rail portions and having short portions extending therebeyond to outboard ends, and a front brace portion bridging between the front leg portions, all made from thin rod stock, the rear of each bottom rail portion having a turned-up generally vertical terminal portion, two rear leg members of rod stock having greater thickness, strength, and stiffness than the rod stock from which the front frame member is made, each said rear leg member having a lower end butt-welded to the top of a said terminal portion, each said rear leg portion being welded also to a said outboard end of said rear connecting portion and upper portions extending thereabove to an upper end, a seat secured to and supported by said side rail portions and said rear connecting member, a back secured to said upper portions of said rear leg members, each said rear leg member having a horizontal portion extend outwardly of said chair at its upper end, said horizontal portion then being bent forwardly of said chair to provide an arm-support portion parallel to the seat-supporting side rail portion but outboard from it, said arm-support portion extending forward about halfway from the rear of the chair to its front, a flat arm-support plate secured to said arm-support portion of the frame and an armrest secured to said arm-support plate.

6. The stacking armchair of claim 1 having two pairs of glides secured to and extending below each said bottom rail, one below the front end thereof and one below the rear end, two pairs of spacer members attached to and extending upwardly from each said bottom rail, one at the front and one at the rear, said spacer members being aligned with their associated glides so as to engage approximately centrally with the corresponding glides of a like chair stacked thereabove.

7. The stacking armchair of claim 5 wherein each said plate is welded to its said arm-support portion and is secured to said armrest by screws extending up from the bottom of said plate through openings into blind threaded openings in said armrest.

8. A stacking armchair including in combination:

two symmetrical front frame members, each having a bottom rail portion, a front leg portion, and a seat side rail portion, the rear of each bottom rail portion having a turned-up generally vertical terminal portion, said front frame members being made from thin rod stock, a rear connecting member connecting together the rear ends of the side rail portions and having short portions extending therebeyond to the outboard end, a pair of rear leg members of rod stock being thicker and having greater strength and stiffness than the rod stock from which the front frame members are made, each said rear leg member having a lower end welded to said terminal portions, said rear leg portions being welded also to said outboard ends of said rear connecting member, and having an upper portion thereabove, a seat secured to and bridging between said side rail portions and secured to said rear connecting member, a back secured to and bridging across the upper portions of said rear leg portions, each said rear leg member having a short outwardly extending horizontal portion that is bent to provide a forwardly extending arm-support portion parallel to the seat-supporting side rail portion but outboard from it, and a chair arm secured to each said arm-support portion.

* * * * *